US008590617B2

(12) United States Patent
Nutley et al.

(10) Patent No.: US 8,590,617 B2
(45) **Date of Patent: *Nov. 26, 2013**

(54) APPARATUS AND METHOD FOR PROVIDING AN ALTERNATE FLOW PATH IN ISOLATION DEVICES

(71) Applicant: Swelltec Limited, Aberdeen (GB)

(72) Inventors: Kim Nutley, Aberdeenshire (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/848,552

(22) Filed: Mar. 21, 2013

(65) Prior Publication Data

US 2013/0233541 A1 Sep. 12, 2013

Related U.S. Application Data

(63) Continuation of application No. 12/615,460, filed on Nov. 10, 2009, now Pat. No. 8,403,046.

(30) Foreign Application Priority Data

Nov. 11, 2008 (GB) ..... 0820619.5

(51) Int. Cl.
*E21B 33/047* (2006.01)

(52) U.S. Cl.
USPC ..... 166/278; 166/51

(58) Field of Classification Search
USPC ..... 166/51, 278
See application file for complete search history.

(56) References Cited

U.S. PATENT DOCUMENTS

| | | | | |
|---|---|---|---|---|
| 4,258,787 | A | 3/1981 | Amancharla | |
| 5,337,808 | A | 8/1994 | Graham | |
| 6,157,893 | A | 12/2000 | Berger et al. | |
| 6,298,916 | B1 | 10/2001 | Tibbles et al. | |
| 7,784,532 | B2 * | 8/2010 | Sevre et al. | 166/51 |
| 8,403,046 | B2 * | 3/2013 | Nutley et al. | 166/278 |
| 2002/0174984 | A1 | 11/2002 | Jones | |
| 2007/0240883 | A1 | 10/2007 | Telfer | |
| 2008/0066900 | A1 | 3/2008 | Saebi et al. | |

FOREIGN PATENT DOCUMENTS

| | | |
|---|---|---|
| GB | 2365897 | 2/2002 |
| WO | 2004061265 | 7/2004 |
| WO | 2006034214 | 3/2006 |

* cited by examiner

*Primary Examiner* — William P Neuder
(74) *Attorney, Agent, or Firm* — Wong, Cabello, Lutsch, Rutherford & Brucculeri LLP

(57) ABSTRACT

An apparatus for use in a wellbore is described, the apparatus having a tubular body and a throughbore which defines a primary fluid path through the apparatus. An expanding element is disposed around the tubular body and is configured to provide an annular barrier in a space between the tubular body and a surrounding wall. A conduit defining a secondary flow path through the apparatus is provided, and is configured to be in fluid communication with at least one alternate path, such as a shunt tube. The conduit is arranged to vary the secondary flow path along a longitudinal direction of the apparatus, for example to redirect the flow path to a radial position closer to the tool body. The conduit is configured to have a reduced effect on the operation of the expanding element, while still allowing the conduit to be coupled to alternate flow paths of adjacent apparatus.

22 Claims, 10 Drawing Sheets

APPARATUS AND METHOD FOR PROVIDING AN ALTERNATE FLOW PATH IN ISOLATION DEVICES

CROSS-REFERENCE TO RELATED APPLICATIONS

This application is a continuation of U.S. patent application Ser. No. 12/615,460, filed Nov. 10, 2009, which claims priority from United Kingdom Patent Application No. GB0820619.5, filed on Nov. 11, 2008, which is hereby incorporated by reference in its entirety.

FIELD OF THE INVENTION

The present invention relates to an apparatus and method for use in wellbores for the hydrocarbon exploration and production industry. The invention relates particularly, although not exclusively, to an apparatus and method for providing an alternate flow path in isolation devices.

BACKGROUND

In the field of oil and gas exploration and production, various tools are used to provide barriers in the wellbore which prevent or restrict the fluid flow. A wellbore packer provides a seal in the annular space between two tubing strings, or between an outer casing and an open hole. A packer may be run with a completion string to a downhole location, and may be inflated or expanded into contact with the outer casing or open hole. The packer may be designed to create a complete fluid seal capable of withholding a differential pressure on either side of the packer, thereby isolating one portion of the annulus from another. Alternatively, the packer may simply provide an annular barrier, to prevent or restrict flow of fluids and/or solid particles in the annulus. Packers may for example be run on completion strings, specialised mandrels, coiled tubing, wireline and slickline tools.

Conventional packers are activated by mechanical or hydraulic systems. More recently, packers have been developed which include a mantle of swellable elastomeric material formed around a tubular body. The swellable elastomer is selected to increase in volume on exposure to a triggering fluid, which may be a hydrocarbon fluid or an aqueous fluid or brine. Alternatively, the elastomer may be selected to increase in volume on exposure to another triggering mechanism, such as heat or pressure. The packer is run to a downhole location in its unexpanded state, where it is exposed to a triggering fluid and caused to expand. The design, dimensions and swelling characteristics are chosen such that the swellable mantle increases in volume to create an annular barrier and/or a fluid seal in the annulus. Swellable packers have several advantages over conventional packers including passive actuation, simplicity of construction, and robustness in long term isolation applications. Examples of swellable packers and suitable materials are described in GB 2411918.

One application of a wellbore packer is as an isolation device in a multi-zone completion system. An example of a multi-zone completion system is shown in FIG. 1. The system, generally shown at 100, includes a production facility at surface, which in this case is a floating production storage and offloading (FPSO) vessel 102, coupled to a well 104 via subsea tree 106. The wellbore in this case is an inclined wellbore which extends through multiple production intervals 107*a*, 107*b*, 107*c* in the formation 108. The production tubing 110 provides a continuous flow path which penetrates through the multiple zones. The production tubing is provided with ports or inflow control devices (not shown) which allow production fluid to flow into the production tubing and out to the subsea tree 106. However, in order to provide control over the production process, the annulus 112 is sealed by packers 114 between the different production zones 107 to prevent fluid flowing in the annulus between the different zones.

Depending on the formation, the production tubing may be provided with sand control devices 116, to prevent solid particles from the formation entering the production tubing. The sand control devices 116 may for example be any suitable sand screen system, including expandable screen systems. The sand control devices may be used in conjunction with one or more gravel packs 118, which comprise gravel or other particulate matter around the sand control device to improve filtration and to provide additional support to the formation. Gravel packing requires a good distribution of gravel in the annulus at the sand control device. To improve the delivery of gravel, sand control devices have been provided with shunt tubes, which create alternate flow paths for the gravel and its carrier fluid. These alternate flow paths significantly improve the distribution of gravel in the production interval, for example by allowing the carrier fluid and gravel to be delivered through sand bridges that may be formed in the annulus before the gravel pack has been completed.

FIGS. 2A and 2B are schematic views of examples of sand screens provided with shunt tubes in a completion system 200. A first sand control device 202*a* is coupled to a second sand control device 202*b*, and each comprise base pipes 204 joined to define a production bore 206. Screens 208 including filter media surround the base pipe 204 and are supported by ribs 210. The apparatus is provided with shunt tubes 212, which in this example are steel tubes having substantially rectangular cross-section. The shunt tubes 212 are supported on the exterior of the screen and provide a flow path 213 alternate to the main production bore 206. Jumper tubes 211 are used to provide fluid communication between shunt tubes of adjacent sand control devices. The shunt tubes 212 maintain a flow path 213, even if the annular space 214 is bridged, for example by a loss of integrity in a part of the formation 216. Examples of shunt tube arrangements can be found in U.S. Pat. No. 4,945,991 and U.S. Pat. No. 5,113,935. The shunt tubes may also be internal to the filter media, as described in U.S. Pat. No. 5,515,915 and U.S. Pat. No. 6,227,303.

Use of alternate path screen systems creates difficulties in wellbore isolation. In particular, alternate paths prevent the use of conventional wellbore packers to isolate multiple production zones. It is proposed in WO 2007/092082 and WO 2007/092083 to provide packers with alternate path mechanisms which may be used to provide zonal isolation between gravel packs in a well. The packers described may include individual jumper tubes over a common manifold or manifold region that provides fluid communication through the packer to shunt tubes of sand control devices. Embodiments described in WO 2007/092082 and WO 2007/092083 include packers with swellable mantles which increase in volume on exposure to a triggering fluid.

However, WO 2007/092082 and WO 2007/092083 do not fully address the complexities of providing fluid barriers and/or fluid isolation using swellable elastomer systems. For example, WO 2007/092082 and WO 2007/092083 are concerned with providing a continuous flow path, but do not address the problems of maintaining the required annular barrier or fluid seal functions of the packer with the provision of the secondary flow path through the apparatus. Such problems may arise due to removal of a volume of elastomer from the isolation device, improper sealing around the conduits, displacement of the conduits due to expansion of the element, and/or coupling of the conduits at opposing ends of the isolation device.

In particular, the arrangements proposed in these WO 2007/092082 and WO 2007/092083 necessitate a reduction in the overall volume of the expanding element, and in particular a reduction in the volume of the expanding element which is radially outward of the conduit. An arrangement with individual jumper tubes requires the jumper tubes to be aligned with the shunt tubes of the adjacent sand control devices. WO 2007/092082 discloses an outer diameter of expanding element which is significantly below the outer diameter of adjacent sand control devices. This configuration would limit the swelling performance from a swellable mantle as it provides minimal mantle thickness. It is possible that at its fully swollen state it would not contact the internal diameter of the drilled wellbore. In addition, configuring a swellable elastomer well packer to achieve a seal at a fully swollen condition may mean extremely long or impractical sealing times and marginal pressure sealing performance if the swellable mantle did manage to contact the wellbore.

The arrangement which comprises a manifold would also be inefficient in finding a nominal balance of swellable mantle thickness. The arrangement requires the outer diameter of the sleeve defining the manifold to extend beyond the radial position of the shunt tubes such that the sleeve has an outer diameter equivalent to the outer diameter of adjacent sand control devices. This has the effect of reducing the volume of the expanding element which may be positioned on the outside of the conduit. This may compromise the integrity of the seal provided by the expanding element and/or increase the time to seal. Alternatively, if the volume of the expanding element is to be maintained, the run-in diameter of the expanding element is increased beyond the diameter of the shunt tubes, and the swellable mantle is be the largest tool diametrically within a sand control string. This limits swelling performance and can impact on the success of deployment operations. It is desirable for the packer outer diameter to be small during run-in to avoid contact with obstructions, for example ledges or washout zones. When using swellable elastomer materials, they may begin to expand as they contact drilling or wellbore fluids during run-in to the desired position in the wellbore.

It is therefore an object of the invention to provide an apparatus in the form of an isolation device, packer and/or annular barrier and method of use which overcome or mitigate at least one drawback or deficiency of previously proposed apparatus and methods.

It is a further object of the invention to provide a wellbore completion and/or production system or method of use which incorporates such an apparatus or method.

It is a further object of the invention to provide an apparatus or method which is an alternative to the method or apparatus described in the prior art.

Further aims and objects of the invention will become apparent from the reading of the following description.

SUMMARY OF THE INVENTION

According to a first aspect of the invention, there is provided an apparatus for use in a wellbore comprising: a tubular body having a longitudinal axis and a throughbore which defines a primary fluid path through the apparatus; an expanding element disposed around the tubular body and configured to provide an annular barrier in a space between the tubular body and a surrounding wall; and a conduit defining a secondary flow path through the apparatus and configured to be in fluid communication with at least one alternate path in an adjacent wellbore component, wherein the conduit is arranged to vary the secondary flow path along a longitudinal direction of the apparatus.

By varying the secondary flow path, the apparatus of the invention is configured for improved operation of the expanding element of the apparatus. For example, the required annular barrier and/or sealing function of the expanding element can be maintained even with the provision of the secondary flow path through the apparatus. The conduit is configured to have a reduced effect on the operation of the expanding element, while still allowing the conduit to be coupled to alternate flow paths of adjacent apparatus.

The apparatus may be a wellbore packer, configured to provide a seal in the space between the tubular body and the surrounding wall. The apparatus may alternatively be configured to provide an annular barrier which inhibits fluid flow in the space and/or prevents the movement of solid particles in the annulus.

The at least one alternate path may be defined by at least one shunt tube. The adjacent wellbore component is preferably a sand control apparatus, such as a screen. The apparatus is preferably operable to be coupled to a first sand control device and a second sand control device. The conduit is preferably configured to be in fluid communication with a first shunt tube of a first of a first sand control device disposed in an uphole direction of the apparatus. The conduit may be in fluid communication with a second shunt tube of a second sand control device disposed in a downhole direction of the apparatus.

The conduit is configured for the passage of a carrier fluid containing particulate matter for a gravel pack, and thus the apparatus may be used in a gravel pack operation. The gravel pack may be formed at least in part at the location of a sand control device disposed in a downhole direction of the apparatus. The gravel pack may be formed by passing the carrier fluid through a first shunt tube of a first sand control device disposed in an uphole direction of the apparatus, and through the conduit of the apparatus. The carrier fluid may be passed through a second shunt tube of a second sand control device disposed in a downhole direction of the apparatus.

The conduit may be arranged to vary a radial dimension of the secondary flow path. The conduit may be arranged to vary the secondary flow path by changing the direction of fluid flowing in the secondary flow path. In particular, the conduit may be arranged to change the radial distance of the flow path from the longitudinal axis of the apparatus. Thus the radial position of the flow path can be selected to improve the operation of the expanding element. Embodiments of the invention therefore have the advantage that the apparatus can be used with standard alternate flow path and shunt tube configurations adopted by various manufacturers of alternate paths and control systems.

Preferably, the conduit is configured to redirect the fluid flow radially inward of the apparatus. The conduit may comprise a first portion configured to redirect the flow, and may comprise a second portion arranged parallel to the longitudinal axis of the apparatus. The apparatus may comprise an s-bend in the secondary flow path.

The first portion may be located in a gauge ring of the apparatus, or may be located in the expanding element. Alternatively, the first portion may be located in conduit extension members which are disposed outside of the expanding element and/or gauge ring.

The conduit may comprise an inlet at a first radial distance from the longitudinal axis of the apparatus, and a second portion disposed at a second radial distance from the longitudinal axis of the apparatus, the second radial distance being less than the first radial distance.

Alternatively, or in addition, the conduit may be arranged to vary the secondary flow path by changing the cross-sectional profile of the conduit along the longitudinal direction of the apparatus. This may for example allow the conduit or a portion of it to be repositioned within the apparatus in order to have a minimal impact on the operation of the expanding element. It may also allow the flow area to be redistributed about the circumference of the apparatus to reduce the radial dimension of the flow path.

The cross-sectional profile of the secondary flow path may be varied such that the total cross-sectional area of the conduit is substantially the same along the longitudinal direction of the apparatus. Thus the rate of flow of fluid through the conduit is substantially unaffected. Alternatively, the cross-sectional shape of the secondary flow path may be varied to change the total cross-sectional area of the secondary flow path longitudinally along the apparatus.

The apparatus may comprise a manifold portion arranged to receive fluid from and/or direct flow into a plurality of conduit members. The manifold portion may be annular or part-annular.

The apparatus may comprise a conduit bore formed in the tubular body, which may be formed longitudinally in the wall of the tubular body. A plurality of conduit bores may be provided. The conduit bores may be in fluid communication with an alternate flow path via a manifold, and or via a flow path in a gauge ring.

The apparatus may comprise one or more conduits integrally formed with the tubular body. Alternatively, or in addition, the apparatus may comprise one or more conduits unitarily formed with the tubular body.

The conduit may comprise a support element such as a tubular conduit member, or may alternatively be defined by a recess or channel in the expanding element. A flexible or collapsible conduit member may be provided.

The apparatus may comprise a gauge ring which is configured to be radially disposed onto the tubular body, for example by clamping. The gauge ring may comprise a recessed channel shaped to receive a conduit. The recess may be configured to deform, bend, or otherwise reshape the conduit. The recess may comprise a wedge-shaped longitudinal profile.

According to a second aspect of the invention, there is provided an assembly for use in a wellbore comprising: an apparatus having a tubular body with a first throughbore and an expanding element disposed around the tubular body and configured to provide an annular barrier in a space between the tubular body and a surrounding wall; and at least sand control device comprising a second throughbore and at least one shunt tube, the at least one sand control device coupled to the apparatus to define a primary flow path through the assembly via the first and second throughbores; wherein the assembly defines a secondary flow path for a gravel pack carrier fluid via the at least one shunt tube and through the apparatus, and wherein the secondary flow path is varied along a longitudinal direction of the apparatus.

According to a third aspect of the invention, there is provided a wellbore installation comprising a production tubular, at least one apparatus of the first aspect of the invention, and at least one sand control device coupled to the apparatus downstream of the apparatus.

Preferably, the wellbore installation comprises a second sand control device coupled to the apparatus upstream of the apparatus, and the apparatus provides a secondary flow path for a gravel pack between the second and first sand control devices.

The wellbore installation may comprise a gravel pack disposed at one or both of the sand control devices.

According to a fourth aspect of the invention, there is provided a method of forming a wellbore installation, the method comprising: locating a sand control device at a downhole location in a producing formation; locating an annular barrier apparatus at a downhole location upstream of the sand control device; gravel packing the sand control device by passing a carrier fluid containing particulate matter through a secondary flow path in the annular barrier apparatus to the sand control device; varying the secondary flow path of the carrier fluid through the annular barrier apparatus.

Varying the secondary flow path may comprise redirecting and/or redistributing the flow. It may comprise changing a radial dimension and/or position of the flow.

According to a fifth aspect of the invention, there is provided an apparatus for use in a wellbore comprising: a tubular body having a longitudinal axis and a throughbore which defines a primary fluid path through the apparatus; an expanding element disposed around the tubular body and configured to provide an annular barrier in a space between the tubular body and a surrounding wall; and a conduit defining a secondary flow path through the apparatus and configured to be in fluid communication with at least one alternate path in an adjacent wellbore component at a first radial distance from the longitudinal axis of the tubular body, wherein at least a portion of the conduit is located at a second radial distance from the longitudinal axis of the tubular body, the second radial distance being less than the first radial distance.

According to an sixth aspect of the invention, there is provided a method of forming a wellbore installation, the method comprising: locating a sand control device at a downhole location in a producing formation; locating an annular barrier apparatus at a downhole location upstream of the sand control device; gravel packing the sand control device by passing a carrier fluid containing particulate matter through a secondary flow path in the annular barrier apparatus to the sand control device; redirecting the secondary flow path from a flow path at a first radial distance from the longitudinal axis of the apparatus to a flow path at a second radial distance from the longitudinal axis of the tubular body, the second radial distance being less than the first radial distance.

According to an seventh aspect of the invention, there is provided an assembly for use in a wellbore comprising: an apparatus having a tubular body with a first throughbore and an expanding element disposed around the tubular body and configured to provide an annular barrier in a space between the tubular body and a surrounding wall; and at least sand control device comprising a second throughbore and at least one shunt tube, the at least one sand control device coupled to the apparatus to define a primary flow path through the assembly via the first and second throughbores; wherein the assembly defines a secondary flow path for a gravel pack carrier fluid via the at least one shunt tube and through the apparatus, and wherein at least a portion of the secondary flow path is located radially closer to the primary flow path than the shunt tube.

According to an eighth aspect of the invention, there is provided a method of forming a wellbore installation, the method comprising: locating a first sand control device at a downhole location in a producing formation; locating an annular barrier apparatus at a downhole location downstream of the first sand control device; locating a second sand control device at a downhole location downstream of the annular barrier apparatus; gravel packing the sand control device by passing a carrier fluid containing particulate matter through a shunt tube of the first sand control device and a secondary flow path in the annular barrier apparatus to the sand control device; redirecting the secondary flow path to be radially closer to the longitudinal axis of the apparatus than the shunt tube.

Embodiments of the various aspects of the invention may comprise preferred and optional features of other aspects of the invention. In particular, embodiments of the fifth and seventh aspects of the invention may comprise features of the first aspect. Embodiments of the invention may have particular application in the methods of operation described in WO 2007/092082 and WO 2007/092083.

DETAILED DESCRIPTION

Figure 1:
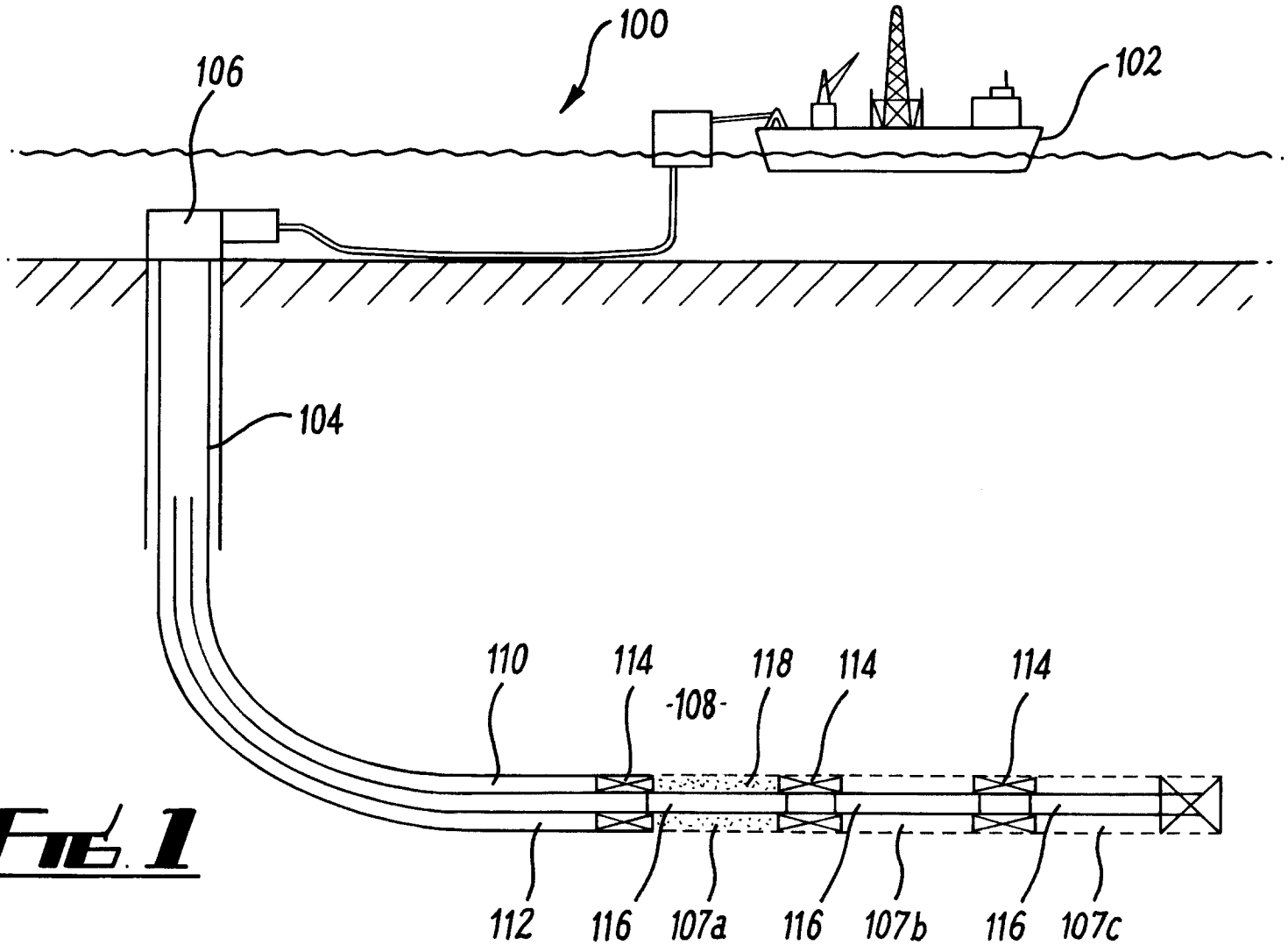
FIG. 1 shows schematically a multi-zone production system in accordance with various embodiments of the invention.
Figure 2A:
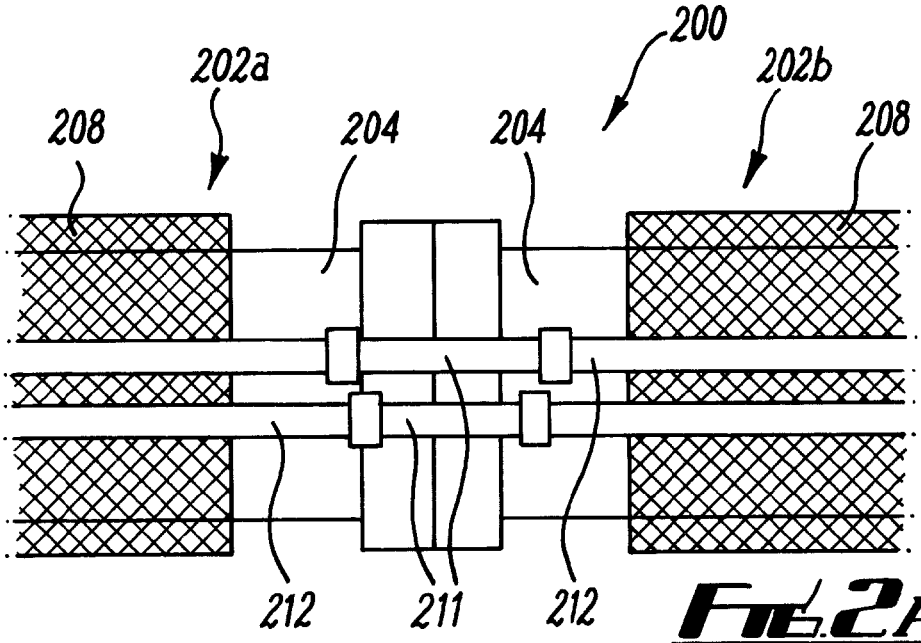
FIG. 2A (Prior Art)
FIGS. 2A and 2B are respectively upper and cross-sectional views of a conventional alternate path screen system.
Figure 2B:
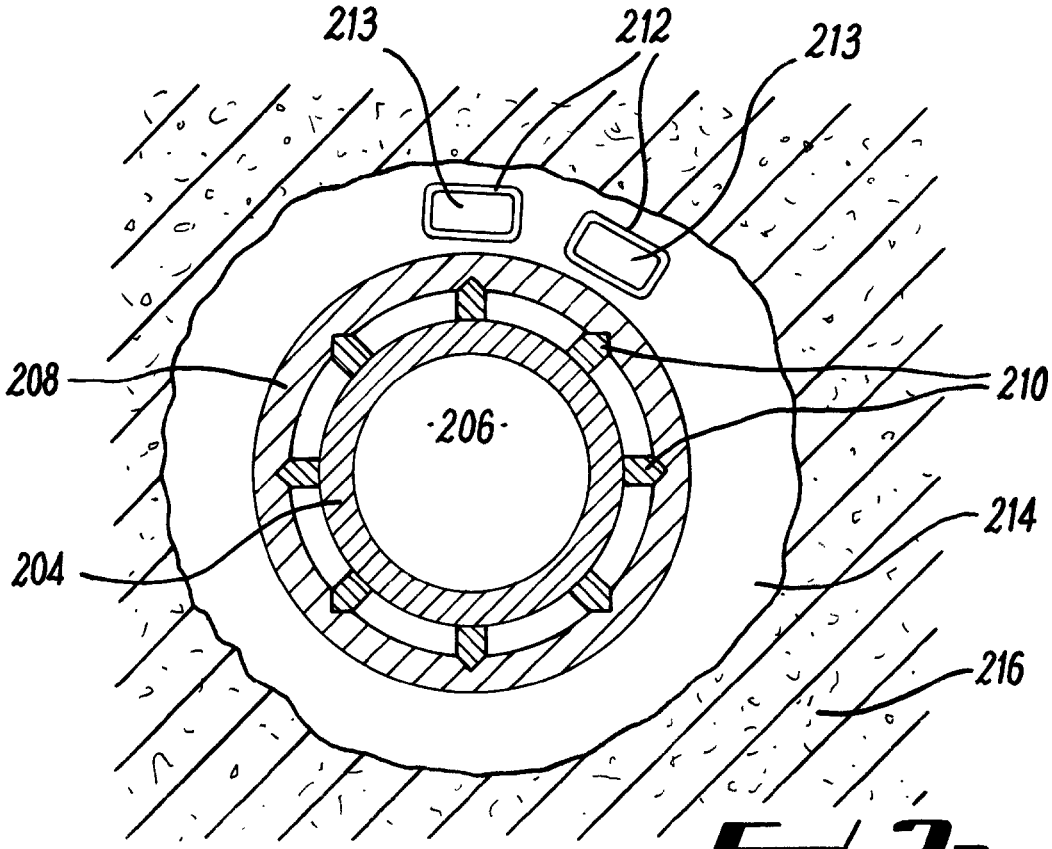
FIG. 2B (Prior Art)
Figure 3A:
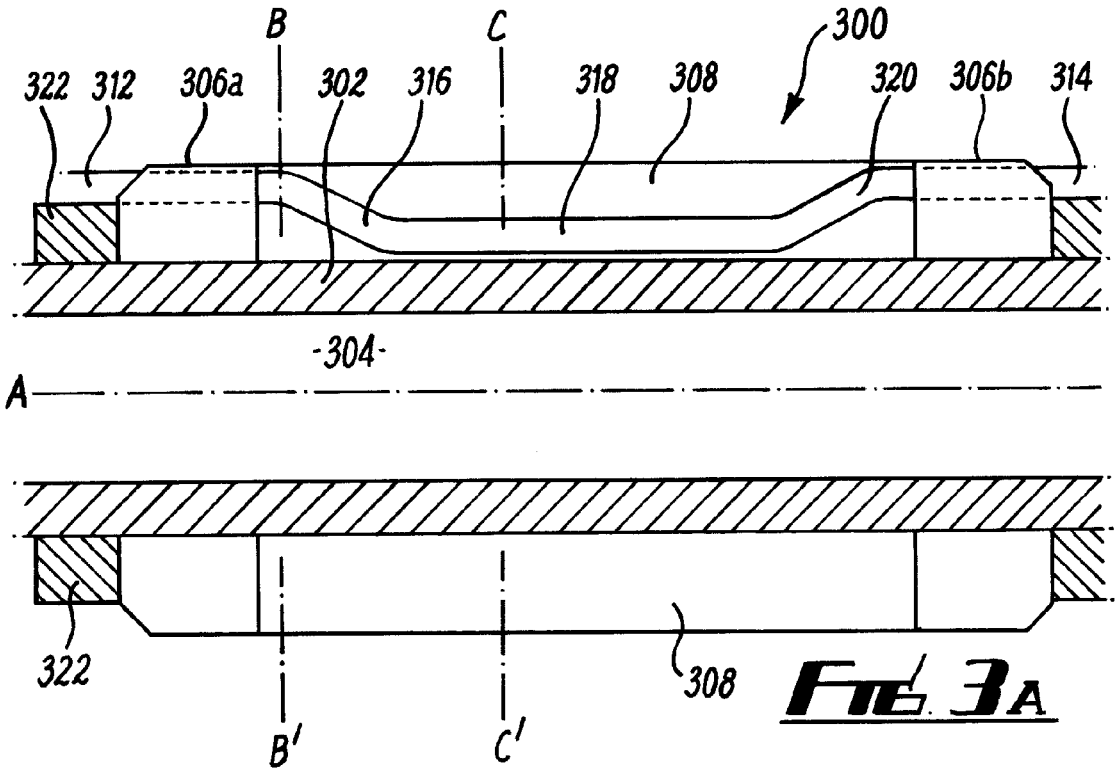
FIGS. 3A to 3C are sectional views of an apparatus in accordance with an embodiment of the invention.
Figure 3B:
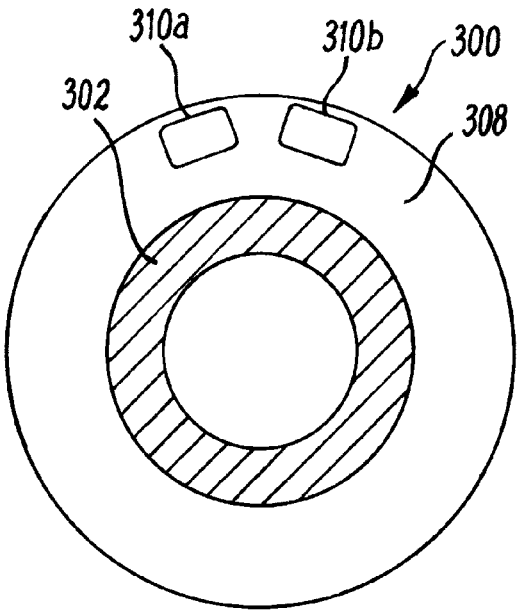
Figure 3C:
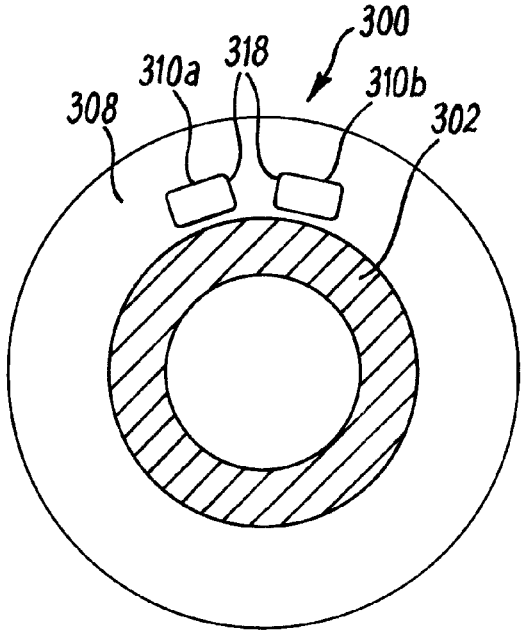

Referring firstly to FIGS. 3A to 3C, there is shown an apparatus in accordance with an embodiment of the invention. The apparatus is a wellbore packer configured to provide an annular seal in an annulus between a production tubing and the wellbore wall of an openhole system. The packer is configured in particular for use in a multi-zone production system, such as that shown in FIG. 1, and is configured for attachment with alternate sand control devices which comprise shunt tubes for delivery of gravel packs to production intervals. FIG. 3A is a longitudinal section through the apparatus 300, and FIGS. 3B and 3C are respectively cross-sectional views through lines B-B' and C-C'.

The packer 300 comprises a tubular body 302 which has a longitudinal axis A and a throughbore 304. The tubular body 302 is provided with couplings (not shown at each end), configured for connection in the production string. In this embodiment, the couplings are suitable for connecting the packer to adjacent screen devices. The throughbore 304 defines a primary flow path for the passage of production fluids through the apparatus 300. Disposed at either end of the apparatus 300 are gauge rings 306*a*, 306*b*, which provide anti-extrusion resistance for the expanding element 308 and may also protect the expanding element from abrasion or contact with the wellbore during deployment operations. The gauge rings also function to secure the expanding element 308 in position on the tubular body 302, preventing axial displacement if the element does contact the wellbore. The gauge rings 306*a*, 306*b* are secured to the tubular body, for example by bolts or corresponding threads which are suitably aligned for a concentric packer design in this embodiment, but which may be aligned for eccentric or offset packer designs in other embodiments.

The expanding element 308 is a swellable mantle, formed from a swellable elastomeric material selected to increase in volume on exposure to a triggering fluid. In this embodiment, the material is an ethylene propylene diene M-class (EPDM) rubber, which increases in volume on exposure to a hydrocarbon fluid. Other suitable materials for the swellable mantle are known in the art, and include elastomers selected to increase in volume on exposure to aqueous fluids or brines, and materials selected to increase in volume on exposure to both aqueous and hydrocarbon fluids. Materials which increase in volume on exposure to other types of stimuli, such as heat and pressure are known in the art, and may be used to form the expanding element in other embodiments.

The apparatus is provided with conduits 310*a*, 310*b* which extend through the apparatus to define a secondary flow path. Each conduit is of sufficient diameter to allow the throughflow of a carrier fluid and a particulate matter used to form a gravel pack. The conduits each comprise a metal tube which extends through the expanding element, and which functions to maintain the flow path through the expanding element. Each conduit includes an inlet 312 and an outlet 314 at opposing ends of the packer. The inlet 312 is configured to be coupled to a shunt tube (not shown) of an alternate path screen located at an uphole position of the packer 300. The outlet 314 is configured for coupling to a shunt tube of a screen located in a downhole position of the packer.

The apparatus also includes an end ring 322 which is configured to support a shunt tube or the conduit members. Conveniently, the end ring may be an end ring of an adjacent sand control system.

Each conduit extends through the gauge rings 306*a*, 306*b* and through the expanding element. The conduit varies the secondary flow path by redirecting the flow path from a first radial position, aligned with the shunt tube, to a second radial position disposed towards the tubular body. In this example, this is achieved by providing a first bended or curved portion 316 of the conduit between the inlet 312 and a central portion 318 of the conduit. Similarly, a second bent or curved portion 320 of the conduit is located between the central portion 318 and the outlet 314. This arrangement allows the central portion of the conduit to be located closer to the tubular body within the expanding element, which increases the volume of the expanding element radially outward of the central portion of the conduit. This improves the operation of the expanding element; by providing a greater volume of the swellable elastomer material outwardly of the conduit, a more effective and more rapid seal can be achieved.

In this embodiment, the conduits 310*a*, 310*b* comprise an s-bend portion which changes the radial position of the secondary flow path within the apparatus. It will be appreciated that other shapes and dimensions of conduit may be provided in alternative embodiments of the invention. It will also be appreciated that any number of conduits may be provided within the scope of the invention.

The apparatus 300 may be manufactured as follows. A base layer of EPDM rubber is formed on the tubular body. A conduit member 310 is located on the base layer of rubber in the required circumferential position, and successive layers of rubber may be formed around the conduit to build up the expanding element and embed it into the packer. The gauge rings may conveniently be of a clamp-on type, for example formed from part-cylindrical components secured together to form an annular ring. Thus the gauge rings may be placed over the conduit member in the required position. Alternatively, the end rings may be slipped on to the tubular body over the conduit members.

Figure 4A:
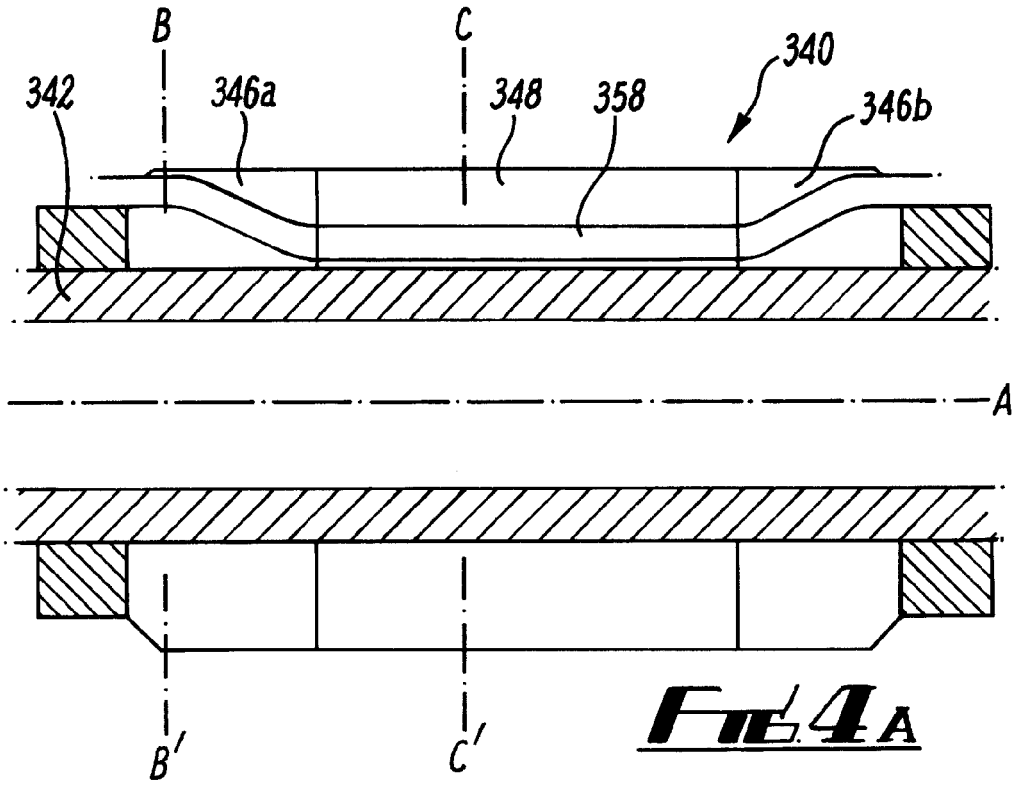
FIGS. 4A to 4C are sectional views of an apparatus in accordance with an alternative embodiment of the invention.
Figure 4B:
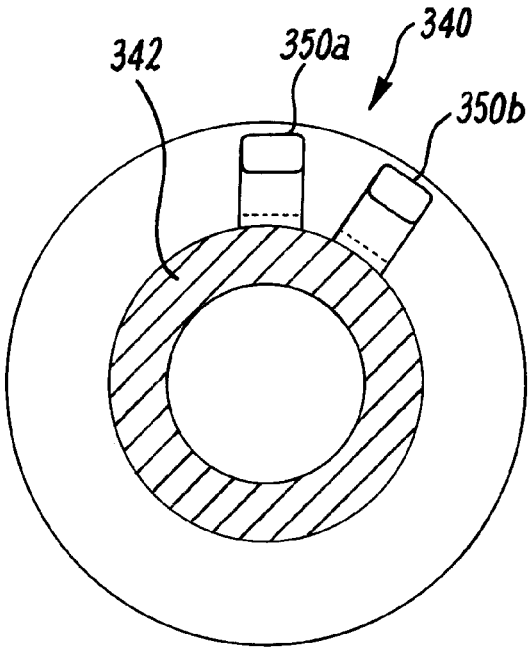
Figure 4C:
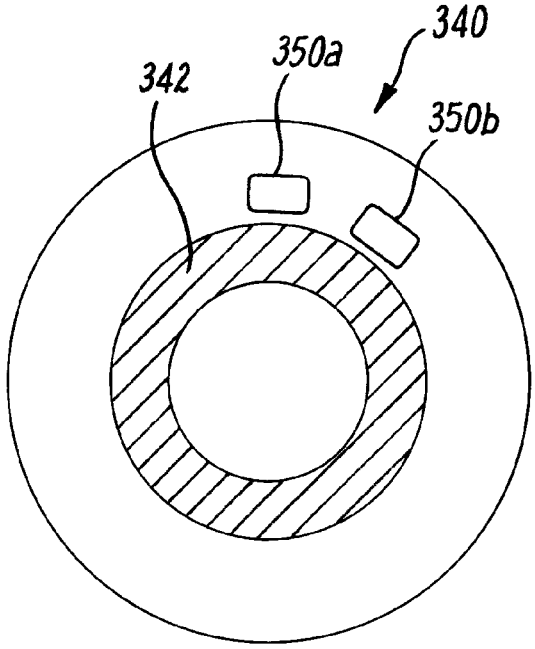

An alternative embodiment of the apparatus is shown in FIGS. 4A to 4C. In this embodiment, the wellbore packer, generally shown at 340, is similar to the apparatus 300, and will be understood from FIGS. 3A to 3C. FIG. 4A is a longitudinal section through the packer 340, and FIGS. 4B and 4C are respectively cross-sectional views through lines B-B' and C-C'.

The packer 340 comprises a tubular body 342, a pair of gauge rings 346*a*, 346B, and an expanding element 348. FIG. 4B is a section through the gauge ring 346*a*.

The apparatus comprises a pair of conduits 350*a*, 350*b* configured to be in fluid communication with shunt tubes of adjacent sand control devices, in the manner described with reference to FIGS. 3A to 3C. The secondary flow path defined by the conduits 350 is varied by redirection of fluid flow. The packer 340 is similar in function to the packer 300, but differs in that the redirection of the flow takes place in portions of the conduit 356, 360 located in the gauge rings 346*a*, 346B. The central portion 358 of the conduit which extends through the expanding element 348 is parallel to the longitudinal axis A of the apparatus. Thus throughout the length of the expanding element, the apparatus has a sufficient volume of swellable elastomeric material located radially outward of the conduit.

Figure 5:
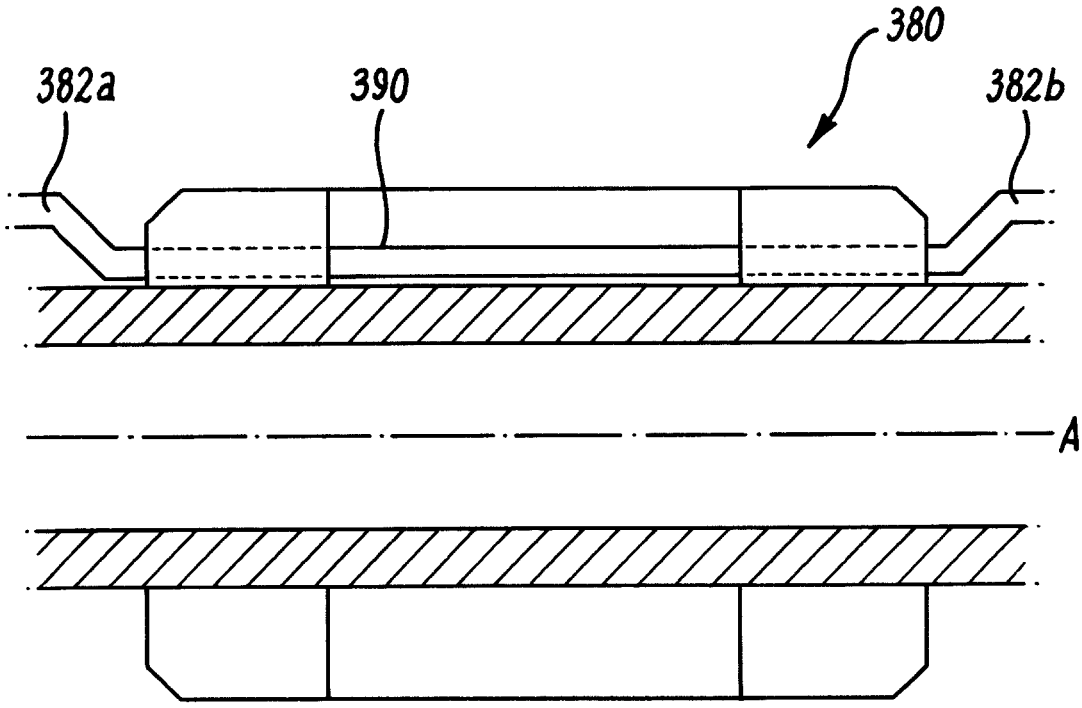
FIG. 5 is a longitudinal section through an apparatus in accordance with a further embodiment of the invention.

FIG. 5 shows an alternative embodiment of the invention, which will be understood from FIGS. 3 and 4. In this embodiment, the apparatus 380 is provided with conduit extension members 382*a*, 382*b*. The conduit 390 extends through the gauge rings and the expanding element in a direction substantially parallel to the longitudinal axis A. The secondary flow path defined by the conduit is varied by redirecting the flow in the portions of the conduit defined by the conduit extension members 382. Each conduit extension member redirects the flow path from a first radial position, aligned with shunt tubes of adjacent sand control apparatus, to a second radial position disposed towards the tubular body.

Figure 6A:
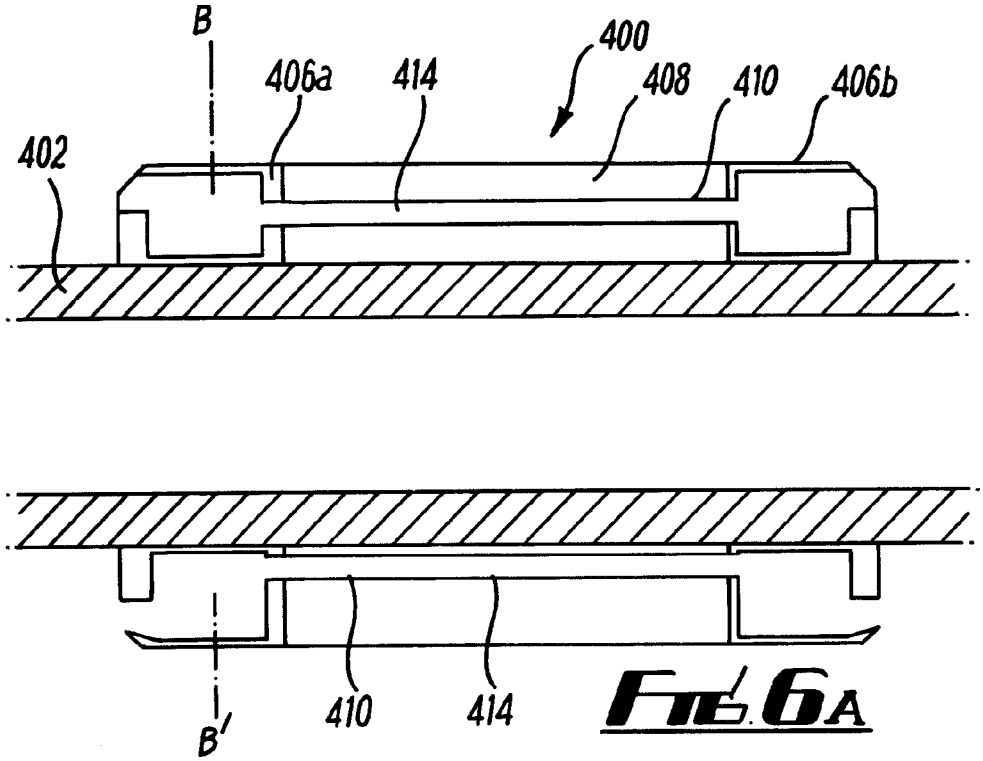
FIGS. 6A to 6C are sectional views through an apparatus in accordance with a further alternative embodiment of the invention.
Figure 6B:
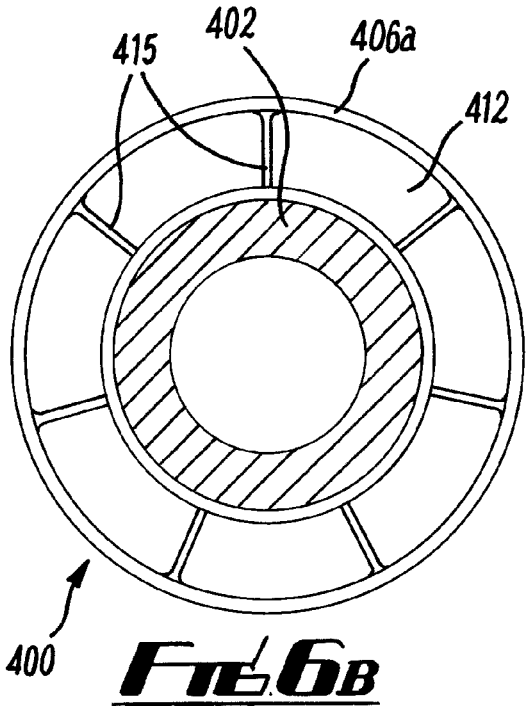
Figure 6C:
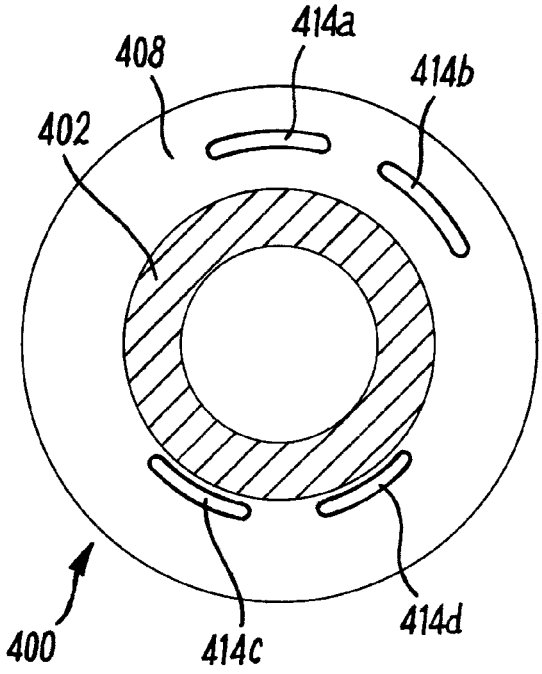

FIGS. 6A to 6C show an apparatus 400 in accordance with a further alternative embodiment of the invention. The apparatus 400 comprises a tubular body 402, a pair of gauge rings 406*a*, 406*b*, and expanding element 408. Conduits 410 extend through the apparatus, and comprise a manifold portion 412 and tubular conduit members 414. The manifold portions 412 are formed as annular chambers in the gauge rings 406, and comprise an inlet in fluid communication with a shunt tube of an adjacent screen. The manifold portions 412 are provided with support members 415 which improve the strength of the gauge ring. The tubular conduit members extend between the respective manifold portions 412 through the expanding element 408. In this embodiment, the tubular conduit members have a cross-sectional shape which is modified with respect to the previous embodiments. The cross-sectional shape has a circumferential dimension which is significantly greater than a radial dimension. In other words, the cross section is flattened in the radial dimension. Providing such a shape of tubular varies the flow path by redistributing flow about the circumference of the apparatus, correspondingly reducing the radial space taken by the tubular conduit members (for the same cross sectional flow area). This allows a greater volume of the expanding element to be located radially outward of the tubular portion. Thus the effect on the expanding element may be reduced without substantially changing the radial position of the flow paths themselves, in the case of tubular conduit members 414*a*, 414*b*. Some or all of the tubular conduit members may be disposed further towards the tubular body, as is the case with tubular conduit members 414*c* and 414*d*. This increases the volume of the expanding element located radially outward of the conduit to a greater extent than is possible with the embodiments of FIGS. 3 to 5.

It will be appreciated that the cross-sectional shapes of the tubular conduit members of the conduit may also be used with the s-bend configurations shown in FIGS. 3 to 5 (or indeed other flow-redirecting configurations). In this case, the conduit may comprise a transitional portion (which may include a nozzle portion and/or a flared portion) which alters the shape of the conduit.

The arrangement of FIG. 6 also redistributes the flow from two shunt tubes of the screen system to four tubular conduit members 414 in the apparatus. This allows the respective flow areas of the tubular conduit members 414 to be reduced, allowing repositioning within the expanding element to a position which reduces the effect of performance on the function of the expanding element.

In FIG. 6, the manifold portion 412 is an annular chamber extending around the tubular body. However, in other embodiments, the manifold portion may only be on a circumferential part of the tubular body, and may not extend around its entire circumference. For example, in an embodiment where two tubular conduit members (such as 414*c* and 414*d*) are used, the manifold portion may be provided around sufficient circumferential distance to be in fluid communication with the openings to the tubular conduit members.

Figure 7:
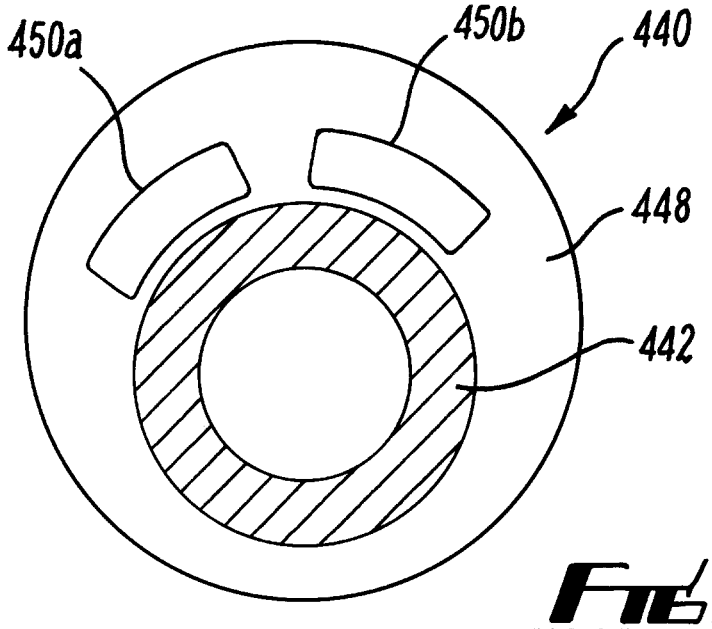
FIG. 7 is a cross-sectional view through an embodiment of the invention having an eccentric configuration.

The foregoing embodiments of the invention have an expanding element and corresponding gauge rings which are concentric with respect to the tubular body. In other embodiments, the expanding element and gauge rings may be eccentric on the tubular body, in order to provide a greater available radial depth conduits can be accommodated. Indeed, many alternate path sand control systems are eccentrically formed on the base pipe to accommodate shunt tubes on one side of the apparatus, and the apparatus of embodiments of the invention may be similarly arranged to allow it to be conveniently used with such systems. An exemplary arrangement is shown in cross section in FIG. 7. Packer 440 comprises a tubular body 442 and an expanding element 448 eccentrically located on the body. Conduits 450*a*, 450*b* define a secondary flow path through the expanding element, as will be understood from the previous embodiments. The conduits are located on one side of the apparatus to correspond with the location of the shunt tubes of the adjacent sand control devices. In this example, the conduits 450 are shaped to increase their circumferential dimension and reduce the radial dimension, relative to the dimensions of the corresponding shunt tubes. The conduits are also positioned radially inwardly of the shunt tubes, towards the tubular body, to increase the external volume of expanding element.

Figure 8:
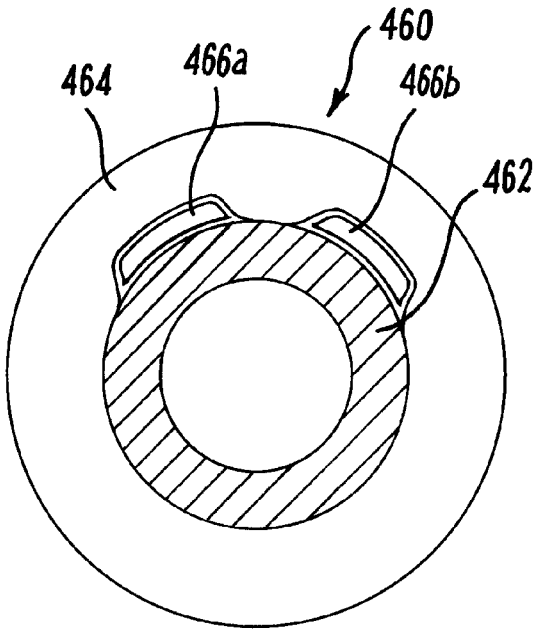
FIG. 8 is a cross-sectional view through an apparatus in accordance with an embodiment of the invention.

FIG. 8 is a cross-sectional view through an apparatus 460 in accordance with a further alternative embodiment. The apparatus comprises a tubular body 462 surrounded by an expanding element 464. The figure is a cross-section through a central portion of the packer 460. Conduits through the packer 460 are provided by tubular conduit members 466*a*, 466*b*, which are in a fluid communication with shunt tubes via a suitable manifold provided at end of the packer 460. The tubular conduit members 466*a*, 466*b* are similar to the tubular conduit members 414*c*, 414*d* of FIG. 6C. The cross-section has been radially flattened (with respect to the cross-sections of corresponding shunt tubes) to redistribute the flow in a circumferential direction of the apparatus. The apparatus of FIG. 8 differs from the apparatus of FIG. 6C in that the tubular conduit members 466*a*, 466*b* are placed on the tubular body 462, and welded on to the body to create a seal. The tubular conduit members 466*a*, 466*b* are thus integrally formed with the tubular body in order to maximise the volume of the expanding rubber which is located radially outward of the tubular conduit members on the tool. In this embodiment, the tubular body is shown concentric with the expanding element, although in other embodiments it may be eccentrically formed with the tubular conduit members located in the high radius side of the expanding element 464.

Figure 9:
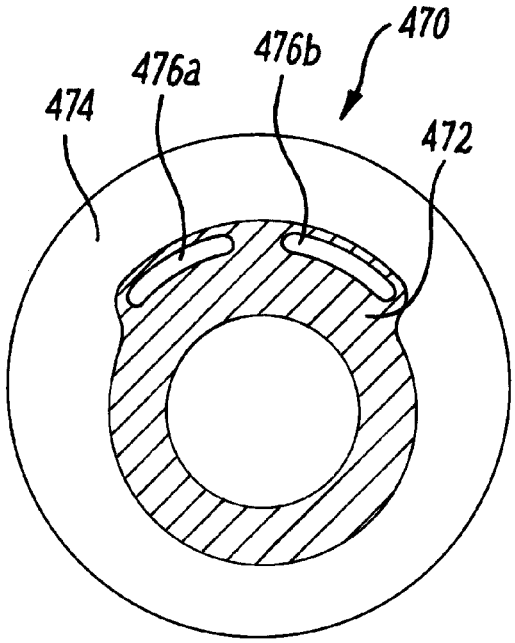
FIG. 9 is a cross-sectional view through an apparatus in accordance with a further alternative embodiment of the invention.

FIG. 9 shows an alternative apparatus 470, which is similar to the embodiment of FIG. 8. However, in this embodiment, the tubular conduit members are formed in a unitary construction with the tubular body 472. The expanding element 474 is formed eccentrically with the tubular body 472 with the tubular conduit portion 476*a*, 476*b* located in the high radius side of the expanding element. However, the arrangement could equally be concentrically formed.

Figure 10A:
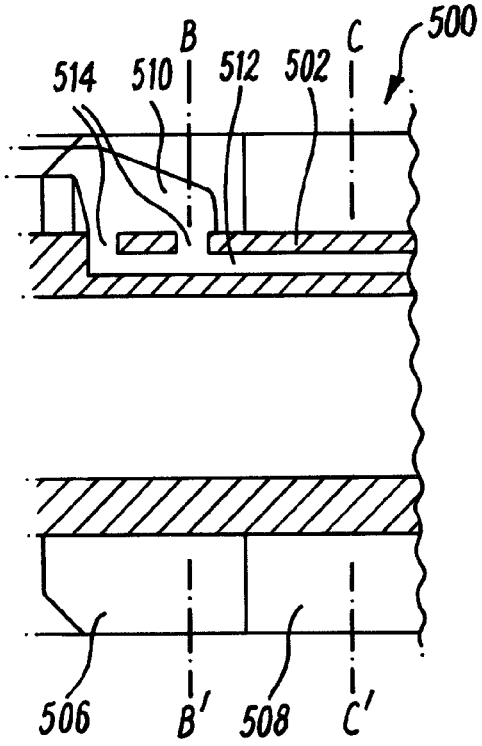
FIGS. 10A to 10C are sectional views through an apparatus in accordance with an embodiment of the invention.
Figure 10B:
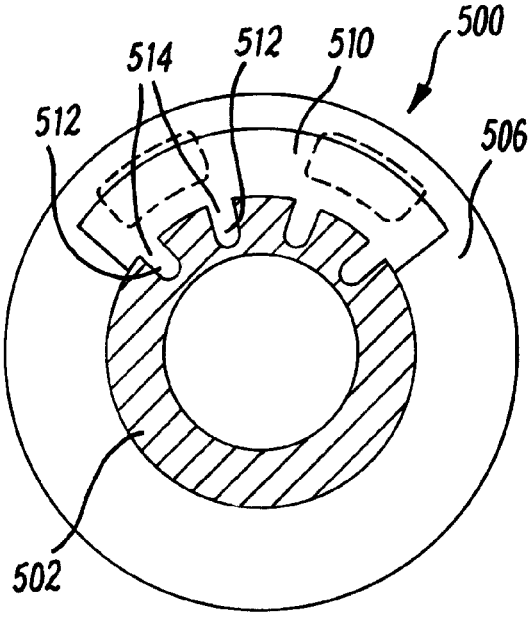
Figure 10C:
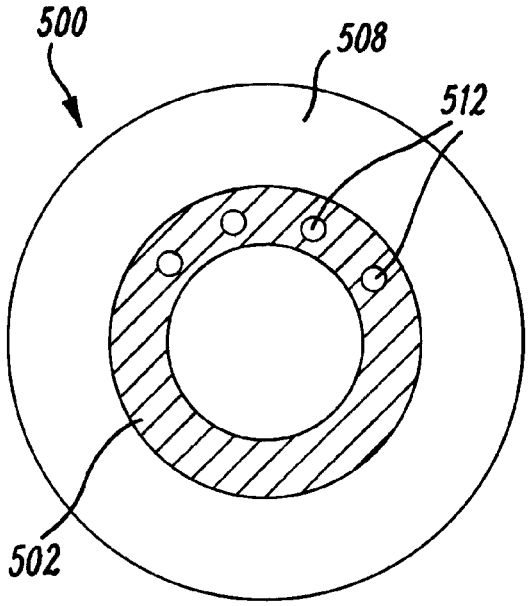

FIGS. 10A to 10C are sectional views through an apparatus in accordance with further alternative embodiments. The apparatus is in the form of a packer 500, which comprises a tubular body 502, a pair of gauge rings 506 (one is shown in FIG. 10A) and an expanding element 508. FIG. 10A is a longitudinal section through one end of the packer 500, FIG. 10B is a cross-section through line B-B', and FIG. 10C is a cross-section through lines C-C'.

The packer 500 has a secondary flow path defined by a manifold 510 in the gauge ring 506 and conduit bores 512 formed in the tubular body itself. The conduit bores 512 are formed longitudinally in the tubular body, and are formed by a gun drilling process. Tubulars portions 512 are in fluid communication with a manifold via radially drilled apertures 514. Fluid from a shunt tube passes into the manifold 510, through the apertures 514 and into the tubular conduit portion 512 and through the apparatus. A similar set of apertures, manifold and coupling for a shunt tube are provided in the opposing gauge ring (not shown).

In this embodiment, four conduit bores 512 are provided, although in other embodiments, for example where it is required to increase the flow area, a large number of conduit portions may be provided.

In a variation to the embodiment of FIGS. 10A to 10C, inserts may be provided in the apparatus to resist erosion due to redirection of the carrier fluid and gravel pack through the manifold and into the tubular conduits. In a further variation, the apertures 514 may be shaped or angled in the direction of fluid flow to reduce flow resistance and corresponding erosion issues (and similar features may also be provided in other embodiments of the invention described herein).

Figure 11:
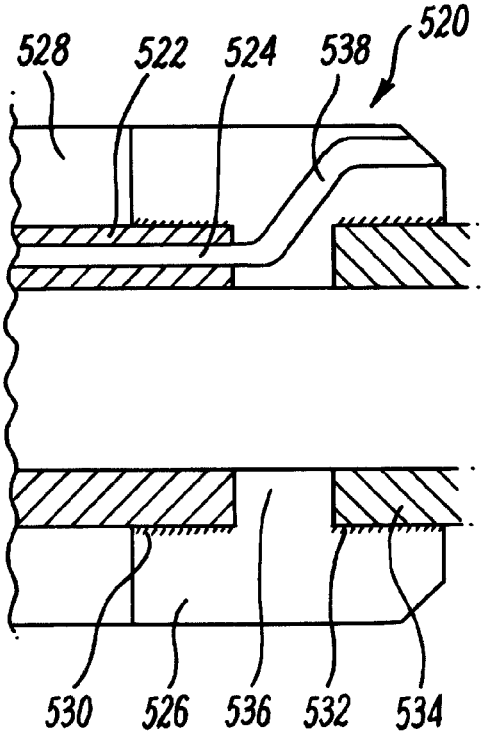
FIG. 11 is a longitudinal section through a part of an apparatus in accordance with an alternative embodiment of the invention.

FIG. 11 shows a further alternative embodiment of the invention. In this embodiment, the packer 520 includes a tubular body 522, with longitudinally drilled conduit bores through the tubular body 522, in a similar manner to the embodiment of FIG. 10. The apparatus 520 differs in that the conduit bores 524 are open to the ends of the tubular body. This provides fluid communication between the conduits in the tubular body and the shunt tubes. The apparatus includes a special coupling gauge ring 526 which is in threaded engagement with the tubular body 522 via thread 530. A threaded coupling 532 is provided at the opposing end of the gauge ring 526 for coupling to an adjacent sand control device 534. The apparatus 520 is provided with a similar gauge ring at its opposing end (not shown). The gauge ring 526 comprises a shoulder portion 536 which abuts the end of the tubular body 522. The open ends of the conduit bores 524 are aligned with a flow path 538 in the special gauge ring which provides fluid communication to a shunt tube (not shown). The gauge ring 526, or portions of it, may be hardened to resist erosion. One advantage of this embodiment is that redirection of the flow takes place in the special gauge ring 526, and the tubular body 522 is unlikely to be subject to erosion issues.

Figure 12A:
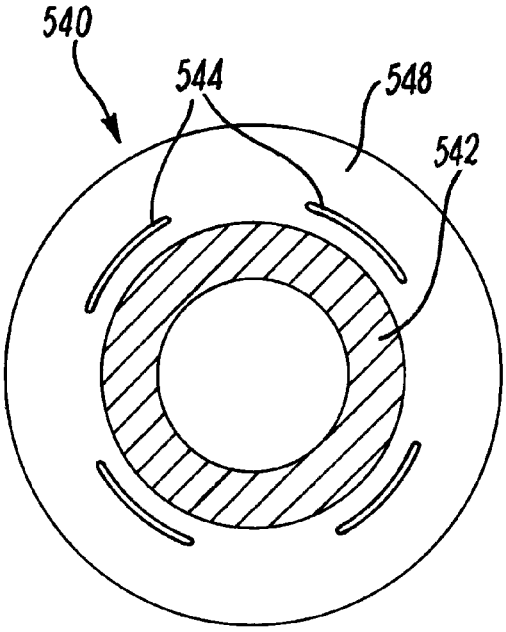
FIGS. 12A and 12B are cross-sectional views of a further alternative embodiment during different stages of operation.
Figure 12B:
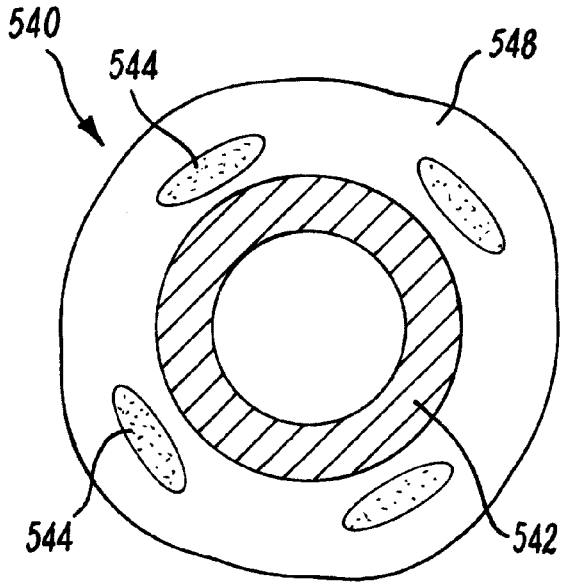

FIGS. 12A and 12B show a further alternative embodiment. The apparatus 540 comprises a tubular body 542 and an expanding element 548, formed from a swellable elastomer or rubber. The apparatus is shown in cross-section through a central portion of the apparatus. Opposing ends of the apparatus are provided with gauge rings and manifolds (not shown) which allow fluid communication between shunt tubes and conduits 544 of the apparatus. In this embodiment, a secondary flow path is formed through the apparatus 540 through conduits 544 formed in the expanding element 548. This embodiment differs from the previous embodiments in that the conduits 544 do not have a rigid support element and are expanded or inflated during use. FIG. 12A shows the apparatus in a configuration where the conduits 544 are not active. The conduits are in a deflated or unexpanded state with minimum cross-sectional area. FIG. 12B shows the same apparatus where the conduits 544 are in an active condition. This occurs when there is sufficient pressure in the flow of the gravel pack carrier fluid to initiate flow through the alternative pathways or shunt tubes in sand control devices, and in turn the conduits 544 within an adjacent packer. The pressure of the gravel pack fluid causes the conduits 544 to partially expand or inflate, which increases their cross-sectional area. This has the effect of expanding the outer diameter of the expanding element 548, improving its ability to provide a seal in the bore. It should be noted that in the majority of gravel pack operations, the conduits 544 will remain packed off with the gravel pack slurry, which will provide continuing support for the conduits 544 in the configuration shown in FIG. 12B.

In an alternative embodiment, the conduits are configured to allow uniform and maximum expansion around the base pipe. This can be achieved by varying the total number of conduits and or increasing or decreasing the expanded/inflated inner diameter of the conduits. The pressure required to open the pathways is in part a function of the rubber thickness around the conduit. Certain embodiments may therefore have conduits placed close to the surface of the expanding element outer diameter. In such a configuration the inflation may create a blister type effect. Again the number and shape of the pathways/conduits would determine the uniformity of the change in outer diameter as the conduits are inflated. The conduit may or may not allow additional swell activation through internal contact of the swellable element with reactive fluids that may be present in the carrier fluid.

Figure 13A:
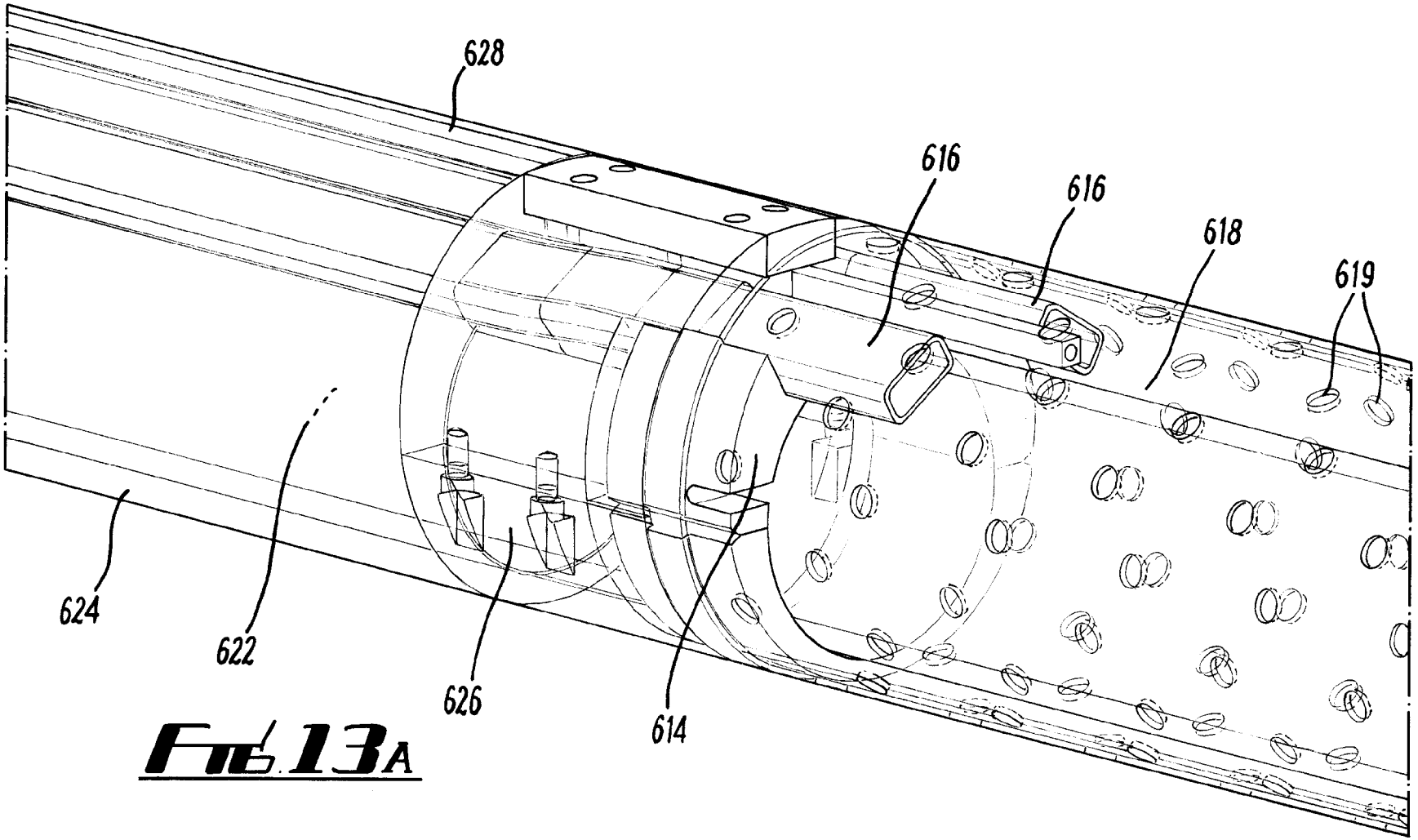
FIGS. 13A and 13B are respectively transparent perspective and partially exploded views of an assembly in accordance with an embodiment of the invention.
Figure 13B:
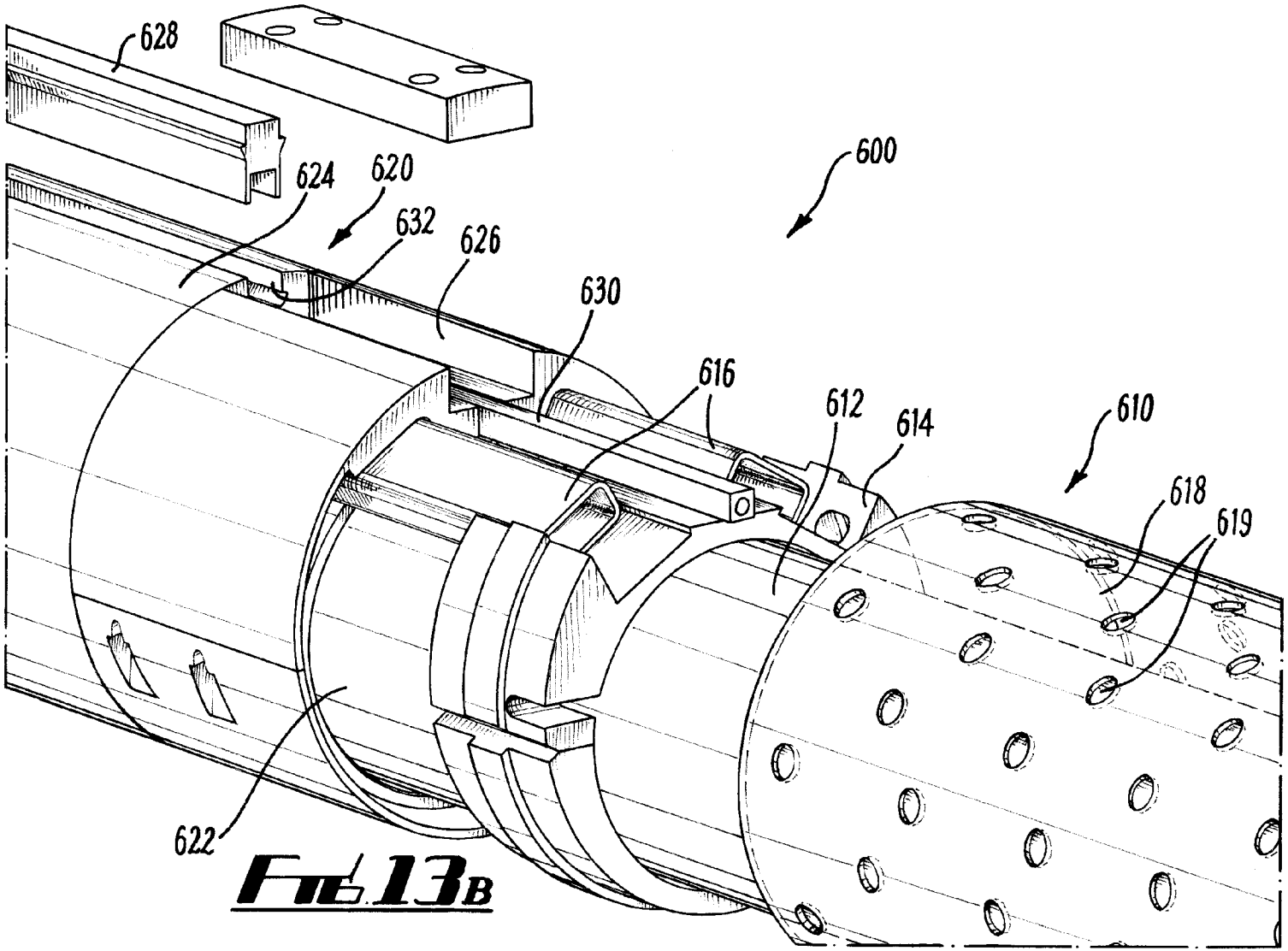

FIG. 13A is a perspective view of an apparatus in accordance with an embodiment of the invention, with various components made transparent to show their interaction. FIG. 13B shows the same apparatus in a partially exploded view. The apparatus, generally shown at 600, comprises a sand control apparatus generally shown at 610, and a packer apparatus, generally shown at 620. The sand control apparatus comprises a base pipe 612, an end ring 614 located on the base pipe, and a pair of shunt tubes (not shown). An auxiliary shroud 618 is provided over the shunt tube to provide a continuous outer diameter to the assembly, and is provided with apertures 619 to allow the throughflow of fluid. The auxiliary shroud 618 functions to protect the shunt tubes, jumper tubes, the exposed ends of the conduit members 616 and any corresponding connectors. The auxiliary shroud extends from the end ring 614 to a corresponding end ring which supports the main shroud of the sand control device. The main shroud extends completely over the sand control device, and provides a protective sleeve for the filter media and shunt tubes. Thus the auxiliary shroud provides a continuous outer diameter in the region of the string between the packer and the main shroud. The end ring 614 supports the shunt tubes and components of the packer apparatus, and provides a support for the end of the shroud 618. The end ring 614 and shroud are eccentrically mounted on the base pipe 612, so that the shunt tubes can be accommodated on the high radius side of the base pipe.

The packer apparatus 620 comprises a tubular body 622, and a packer element 624 surrounded the tubular body. In this case, the packer element is formed from a swellable elastomer such as EPDM. A gauge ring 626 is provided at the end of the packer apparatus, and is in this embodiment configured to be clamped on to the base pipe. The internal surface of the gauge ring is profiled to accommodate conduit members 616, and to be coupled to the end ring 614 of the sand control apparatus. The conduit members are configured to be in fluid communication with the shunt tubes (not shown) or the sand control apparatus, and in this embodiment have the same size, shape and material properties as the shunt tubes. The conduit members 616 extend through the packer apparatus to define a secondary pathway for gravel pack fluid in use.

The packer apparatus 620 is also provided with a cable feedthrough arrangement, which comprises an insert 628 of a swellable material which partially surrounds a cable 630. The insert 628 fits into a corresponding recess 632 in the packer element 624.

The conduit member 616 extends from a longitudinal position adjacent the sand control apparatus 610 and through a recess provided in the end ring 614 at a first radial distance from the base pipe 612. This radial height above the base pipe corresponds to the radial position of the shunt tubes of the sand control apparatus, such that the conduit members are in fluid communication with the shunt tubes. The conduit members 616 extend through the gauge ring 626 and into the packer element 624. The internal profile of the gauge ring 626 is configured such that the radial position of the conduit member at the packer element side of the gauge ring is closer to the base pipe. This is achieved by providing the longitudinal surface of the conduit recess in the gauge ring 626 with a wedge shape profile, such that the opening to the recess at the packer side of the gauge ring is at a radially lower position than the opening to the recess at the sand control apparatus side of the gauge ring. The gauge ring 626 is formed in two parts, and is assembled over the conduit member and secured in place by bolts. The attachment of the gauge ring imparts a clamping force on the conduit members 616 sufficient to deform the conduit to vary the secondary flow path through the apparatus.

The apparatus of the invention is configured for improved operation of the expanding element of the apparatus. For example, the required annular barrier and/or sealing function of the expanding element can be maintained even with the provision of the secondary flow path through the apparatus. The conduit is configured to have a reduced effect on the operation of the expanding element, while still allowing the conduit to be coupled to alternate flow paths of adjacent apparatus. The invention has particular application with swellable wellbore packers.

The conduit may be arranged to vary a radial dimension of the secondary flow path. The conduit may be arranged to vary the secondary flow path by changing the direction of fluid flowing in the secondary flow path. In particular, the conduit may be arranged to change the radial distance of the flow path from the longitudinal axis of the apparatus. Thus the radial position of the flow path can be selected to improve the operation of the expanding element. Embodiments of the invention therefore have the advantage that the apparatus can be used with standard alternate flow path and shunt tube configurations adopted by various manufacturers of alternate paths and control systems.

Variations to the above described embodiments are within the scope of the invention herein intended.

What is claimed is:

1. An apparatus for use in a wellbore comprising:

a tubular body having a longitudinal axis and a throughbore which defines a primary fluid path through the apparatus;

an expanding element comprising a swellable material disposed around the tubular body which when activated expands to provide an annular barrier in a space between the tubular body and a surrounding wall; and a conduit defining a secondary fluid path through the apparatus and configured to be aligned with and in fluid communication with at least one gravel pack shunt tube in an adjacent sand control device, comprising:

a first portion located in the expanding element and configured to redirect the secondary fluid path; and a second portion arranged parallel to a longitudinal axis of the apparatus, wherein the conduit is arranged to vary the secondary fluid path along a longitudinal direction of the apparatus.

2. The apparatus of claim 1 wherein the conduit is arranged to redirect the secondary fluid path radially inward of the apparatus.

3. The apparatus of claim 1 wherein the conduit is arranged to vary the secondary fluid path by changing a cross-sectional profile of the conduit along the longitudinal direction of the apparatus.

4. The apparatus of claim 3 wherein a cross-sectional profile of the secondary fluid path is varied to redistribute a flow area about a circumference of the apparatus and reduce a radial dimension of the secondary fluid path.

5. The apparatus of claim 3 wherein a cross-sectional profile of the secondary fluid path is varied such that a total cross-sectional area of the conduit is substantially the same along the longitudinal direction of the apparatus.

6. The apparatus of claim 3 wherein a cross-sectional shape of the secondary fluid path is varied to change a total cross-sectional area of the secondary fluid path longitudinally along the apparatus.

7. The apparatus of claim 1 operable to be coupled to a first sand control device and a second sand control device.

8. The apparatus of claim 1 wherein at least a portion of the secondary fluid path is located radially closer to the primary fluid path than the shunt tube.

9. The apparatus of claim 1 further comprising a manifold portion arranged to receive fluid from and/or direct flow into a plurality of conduit members.

10. The apparatus of claim 1 comprising one or more conduits integrally formed with the tubular body.

11. The apparatus of claim 1 comprising one or more conduits unitarily formed with the tubular body.

12. The apparatus of claim 1 comprising a recess or channel in the expanding element.

13. The apparatus of claim 1 wherein the conduit comprises a support element such as a tubular conduit member.

14. The apparatus of claim 1 comprising a flexible or collapsible conduit member.

15. A wellbore packer comprising the apparatus of claim 1.

16. A method of forming a wellbore installation, the method comprising:

providing a sand control device at a downhole location in a producing formation;

providing an annular barrier apparatus comprising a swellable member at a downhole location upstream of the sand control device, the apparatus comprising a tubular body and a throughbore which defines a primary fluid path;

gravel packing the sand control device by passing a carrier fluid containing particulate matter through a gravel pack shunt tube and passing the carrier fluid through a conduit forming a secondary fluid path in the annular barrier apparatus to the sand control device;

varying a radial position of the secondary fluid path of the carrier fluid along a longitudinal direction of the annular barrier apparatus in a first portion of the secondary fluid path located in the swellable member; and passing the carrier fluid through a second portion of the secondary fluid path and a second portion arranged parallel to a longitudinal axis of the apparatus.

17. The method of claim 16 comprising varying the secondary fluid path by changing a radial dimension and/or radial position of the secondary fluid path.

18. The method of claim 17 comprising redistributing a flow area about a circumference of the apparatus to reduce the radial dimension of the secondary fluid path.

19. The method of claim 17 comprising forming a gravel pack at least in part at the location of a sand control device disposed in a downhole direction of the apparatus.

20. The method of claim 19 comprising forming a gravel pack by passing the carrier fluid through a first shunt tube of a first sand control device disposed in an uphole direction of the apparatus and through the conduit of the apparatus.

21. The method of claim 20 comprising passing the carrier fluid through a second shunt tube of a second sand control device disposed in a downhole direction of the apparatus.

22. The method of claim 17 comprising redirecting the secondary fluid path to be radially closer to the longitudinal axis of the apparatus than the shunt tube.

* * * * *